US007033095B2

(12) United States Patent
Shiraiwa

(10) Patent No.: US 7,033,095 B2
(45) Date of Patent: Apr. 25, 2006

(54) PRINTING PAPER, PRINT FORMING PROCESS AND PRINTING SYSTEM

(75) Inventor: Yoshinobu Shiraiwa, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/835,443

(22) Filed: Apr. 17, 2001

(65) Prior Publication Data

US 2002/0015086 A1 Feb. 7, 2002

(30) Foreign Application Priority Data

Apr. 20, 2000 (JP) ..... 2000-119367
Apr. 28, 2000 (JP) ..... 2000-130771

(51) Int. Cl.
*B41J 11/00* (2006.01)
*B42D 15/00* (2006.01)

(52) U.S. Cl. ..... 400/636; 400/578; 428/43

(58) Field of Classification Search ..... 400/636; 428/192, 43; 156/257, 277, 268, 384, 387
See application file for complete search history.

(56) References Cited

U.S. PATENT DOCUMENTS

| | | | | |
|---|---|---|---|---|
| 4,547,001 | A | 10/1985 | Stitt | 283/81 |
| 4,890,862 | A * | 1/1990 | Buchholz | 283/62 |
| 4,952,433 | A * | 8/1990 | Tezuka et al. | 428/42.3 |
| 5,002,626 | A | 3/1991 | Tezuka et al. | 156/252 |
| 5,112,427 | A * | 5/1992 | Bekker-Madsen | 156/259 |
| 5,240,755 | A * | 8/1993 | Zimmer | 428/40.1 |
| 5,379,538 | A * | 1/1995 | Osborne | 40/638 |
| 5,658,648 | A * | 8/1997 | Doerr et al. | 428/195.1 |
| 6,001,209 | A * | 12/1999 | Popat et al. | 156/249 |
| 6,153,557 | A * | 11/2000 | Nakanishi | 503/201 |
| 6,222,576 | B1 * | 4/2001 | Goto | 347/218 |
| 6,322,655 | B1 * | 11/2001 | Casagrande | 156/257 |
| 6,427,905 | B1 * | 8/2002 | Flynn et al. | 82/11.1 |
| 6,464,120 | B1 * | 10/2002 | Johnson et al. | 225/2 |
| 6,652,171 | B1 * | 11/2003 | Onishi | 400/621 |
| 6,726,252 | B1 * | 4/2004 | Chaikel et al. | 283/74 |

FOREIGN PATENT DOCUMENTS

| | | | |
|---|---|---|---|
| DE | 43 21 594 | A1 | 1/1995 |
| EP | 355422 | A * | 2/1990 |
| EP | 0 488 813 | A2 | 6/1992 |
| EP | 726164 | A2 * | 8/1996 |
| GB | 1378142 | A * | 12/1974 |
| JP | 4-58369 | U | 5/1992 |
| JP | 7-61151 | A | 3/1995 |
| JP | 07061170 | A * | 3/1995 |
| JP | 8-048058 | | 2/1996 |
| JP | 9-002441 | | 1/1997 |
| JP | 09263075 | A * | 10/1997 |

(Continued)

OTHER PUBLICATIONS

Machine translation of JP 07061170, Nakamura, from Japanese Patent Office website.*

*Primary Examiner*—Daniel J. Colilla
(74) *Attorney, Agent, or Firm*—Fitzpatrick, Cella, Harper & Scinto

(57) ABSTRACT

Disclosed herein is printing paper containing a center portion having a curved edge connecting adjacent sides to each other at four corners and outside portions connected to the center portion at at least one straight line portion of said sides, wherein the center portion and the outside portions are connected to each other through a structure by which the printing paper can be cut.

8 Claims, 7 Drawing Sheets

FOREIGN PATENT DOCUMENTS

| | | | |
|---|---|---|---|
| JP | 10006594 A | * | 1/1998 |
| TW | 308991 | | 6/1997 |
| TW | 327365 | | 2/1998 |
| WO | WO 01/89825 A1 | * | 11/2001 |

* cited by examiner

PRINTING PAPER, PRINT FORMING PROCESS AND PRINTING SYSTEM

BACKGROUND OF THE INVENTION

1. Field of the Invention

The present invention relates to a printing paper which is suitable for use in printing apparatus, and more particularly to a printing paper for providing a print having a particular form, in which an image is printed over substantially the whole surface thereof by an image forming apparatus which moves in a reciprocating manner printing paper to form plural images of various colors so as to overlap each other, thereby giving a color image. The present invention also relates to a print forming process and a printing system.

2. Related Background Art

With the increased popularity of apparatus from which image data can be obtained with ease, such as digital video cameras and digital cameras, there is recently an increase in demand for color image printing apparatus which form a color image on printing paper on the basis of the image data obtained. Printing systems of such color image printing apparatus include, for example, a thermal transfer system and the like. Printing using the thermal transfer system is conducted by arranging an ink sheet, on which a thermal sublimation or hot-melt ink has been coated, in close vicinity to printing paper, selectively heating the ink sheet by a thermal head to transfer the sublimated or melted ink to the printing paper, thereby forming an ink image on the printing paper. A thermal transfer printing apparatus, in particularly, a sublimate-type thermal transfer printing apparatus, by which such printing of the thermal transfer system is conducted, may be used as a printing apparatus to conduct printing on printing paper on the basis of image data obtained from a digital camera or the like to provide a high-quality full-color image.

Apparatus for forming a high-quality full-color image other than those described above, for example, Print Club (trade name) by which a photographic image is formed on a small size sticker that can be easily stuck on a purse, pocket notebook or the like, and films equipped with a lens, which is portable to take photographs and the like have been widely used in recent years. Owing to the increased popularity of these apparatus, prints with high-quality full-color images have been utilized in a form that can be stuck on or put into purses or pocket notebooks to be carried around so that one can appreciate them or show or exchange them with others.

Therefore, prints in the form that can be stuck on or put into purses, pocket notebooks or the like to be carried around are required even of prints prepared by means of a digital camera or the like. There is thus a demand for the development of a printing system which can form such a print. More specifically, with the increased popularity of telephone cards, credit cards and the like, purses and pocket notebooks where such cards can be stored with ease have been widely used. Therefore, there is a demand for the development of a printing system which can form a print of the same size as such cards. The specific form of the telephone cards and credit cards in use is a rectangle of 54 mm×85.5 mm as illustrated in FIG. 12, with their four corner edges rounded in the form of an arc and having a curvature radius R of 4 mm. On the other hand, as printing paper which can provide prints that can be stuck on optional articles, there is so-called label type printing paper (label printing paper) of a constitution like a sticker.

To obtain a print in such a form, the printing paper is generally required to be moved in a reciprocating manner in a printing apparatus, such as a thermal transfer providing apparatus, to form plural images of various colors so as to overlap each other, thereby giving a color image. As a result, image cannot be formed on at least a portion of the ends of the printing paper because the printing paper is required to be supported without detaching it upon printing. Therefore, the resulting print contains a blank portion. In other words, since the size of an image which can be formed is limited in the color image printing apparatus, it is impossible to provide a print in which an image has been formed over the whole surface thereof like a silver salt photograph.

In order to solve such a problem, for a process for providing a print in which an image has been formed over substantially the whole surface thereof, it is known to use printing paper provided with an easy-cut structure 32 by which the printing paper can be easily cut, such as perforations formed of an intermittent cut at both sides in a conveying direction of the printing paper so as to cut outside portions 34 off with ease as illustrated in FIG. 13.

FIG. 16 is a typical side view in the case where the printing paper is label printing paper. As illustrated in FIG. 16, the label printing paper comprises an upper image-receiving layer portion 41 which will become a print which can be stuck on an article, and a lower supporting layer portion (separator) 42 which covers an adhesive portion of the image-receiving layer portion 41 before use to protect it. The image-receiving layer portion 41 has a sealing substrate 44 positioned in the center, a receiving layer 43 provided on the upper surface thereof and receiving coloring materials such as inks for forming an image, and an adhesive layer 45 provided on the lower surface of the seal substrate 44 and having tackiness capable of being stuck on an article. The supporting layer portion 42 has a supporting substrate 47 and a releasing layer 46 provided on the upper surface thereof, through which the image-receiving layer portion 41 can be released, without impairing the tackiness of the adhesive layer 45. By using the label printing paper of this construction, the image-receiving layer portion 41 can be stuck on an article after forming an image on the receiving layer 43 and then releasing the image-receiving layer portion 41 from the support layer portion 42. For the easy-cut structure 32 by which the printing paper can be easily cut, the label printing paper has been subjected to the so-called half-cut treatment in which a cutting line 32*a* formed of a cut continuously formed over the entire width thereof is provided in only the image-receiving layer portion 41. There is also label printing paper in which a perforation 32*b* formed of cuts intermittently formed over the entire width over the entire thickness of the label printing paper composed of an image-receiving layer portion 41 and a supporting layer portion 42 is provided as the easy-cut structure 32 by which the printing paper can be easily cut, as illustrated in FIG. 17. In these side views, the cutting line 32*a* formed of a cut continuously formed over the entire width and the perforation 32*b* formed of cuts intermittently formed over the entire width are typically indicated by a solid line and a two-dot chain line, respectively.

By using the printing paper having such easy-cut structure 32 by which the printing paper can be easily cut, an image can be formed over the entire surface of a center portion 33 other than outside portions 34 outside the easy-cut structure 32 by which the printing paper can be easily cut as illustrated in FIG. 14. Therefore, the outside portions 34 of the printing paper on which an image has been formed are cut off from the easy-cut structure 32 by which the printing paper can be easily cut, whereby a print in which the image has been formed over the entire surface can be provided as illustrated in FIG. 12.

However, a print obtained by using the label printing paper subjected to the half-cut treatment as illustrated in FIG. 16 has to be carried in its original size including the outside portions 34. Such a large print is inconvenient for carrying. On the other hand, a print obtained by using printing paper provided with a perforation 32 as illustrated in FIG. 13 can be carried in a condition in which outside portions 34 have been cut off. However, its four corner edges are in a squarish form. Such a print having the four squarish corner edges involves a problem that it is hard to put into a holder such as a purse, pocket notebook or card case because the edge of the print strikes the holder or is caught thereby upon putting the print into the holder.

In the label printing paper subjected to the half-cut treatment, the image-receiving layer portion 41 can be easily separated from the supporting layer portion 42 and stuck on an article by striking a nail or the like against the position of the cutting line 32*a* along the upper surface of the supporting layer portion 42 of the outside portion 34 to insert the nail or the like between the image-receiving layer portion 41 and the supporting layer portion 42. In the printing paper provided with the perforation 32*b* on the other hand, when the outside portions 34 are cut off, the outside portions of the supporting layer portion 42 are also cut off. Accordingly, a print from which the outside portions 34 have been cut off involves a problem that it is difficult to insert a nail or the like between the image-receiving layer portion 41 and the supporting layer portion 42, and so the image-receiving layer portion 41 is hard to be separated from the supporting layer portion 42.

SUMMARY OF THE INVENTION

It is an object of the present invention to provide printing paper usable in a color image forming apparatus which reciprocatorily moves printing paper to formal plural images of various colors so as to overlap each other, thereby giving a color image. It is also an object of the present invention to provide a printing process and a printing system capable of providing a print having a form that is easy to be held without striking on a holder or being caught thereby upon being put into the holder, and in which an image can be printed over substantially the whole surface thereof.

Another object of the present invention is to provide label printing paper capable of separating an image-receiving layer portion of a print with ease.

The above object can be achieved by the present invention described below.

According to the present invention, there is thus provided label printing paper, which is substantially in the form of a rectangle, comprising a supporting layer portion and an image-receiving layer portion releasably laminated on the supporting layer portion and having a center portion having a curved edge connecting adjacent sides to each other at four corners and outside portions connected to the center portion at at least one straight line portion of said sides, wherein the center portion and the outside portions are connected to each other through a structure by which the printing paper can be cut.

According to the present invention, there is also provided label printing paper comprising a center portion having a curved edge connecting adjacent sides to each other at four corners and outside portions connected to the center portion at at least one straight line portion of said sides, each of the center portion and the outside portions having a supporting layer portion and an image receiving layer portion releaseably laminated on the supporting layer portion, wherein the center portion and the outside portions are connected to each other through a structure by which the printing paper can be cut.

According to the present invention, there is further provided a print forming process using the printing paper described above, comprising the steps of conveying the printing paper while holding the outside portions of the printing paper, conducting printing on the center portion of the printing paper and cutting the outside portions of the printing paper off from the center portion.

According to the present invention, there is still further provided a print forming process using the printing paper described above, comprising the steps of conveying the printing paper while holding the outside portions of the printing paper, conducting printing on the center portion of the printing paper and separating the image-receiving layer portion of the center portion from the supporting layer portion.

According to the present invention, there is yet still further provided a printing system comprising the printing paper described above, a printing head for conducting printing on the printing paper and a pair of conveyer rollers for conveying the printing paper while holding the outside portions of the printing paper.

According to this constitution, outside portions which lie outside connecting portions capable of cutting, such as perforations, can be used as holding portions for guiding the printing paper at an appropriate printing position upon printing using a printing apparatus. Accordingly, an image can be formed substantially over the whole surface of the center portion which lies inside the connecting portions of the printing paper. After forming the image, the outside portions of the printing paper can be cut off with ease, whereby a print in which an image has been printed substantially over the whole surface thereof can be provided. The resultant print has a rectangular form having a curved edge at four corners thereof, i.e., a form easy to be held without striking on a holder or being caught thereby upon putting the print into the holder.

In the case where the printing paper is label printing paper, the structure formed at the connecting portion, by which the printing paper can be easily cut, can be formed from at least a cutting line formed of a cut continuously formed over the entire width over the entire thickness of the image-receiving layer portion and a perforation formed of cuts intermittently formed over the entire width over the entire thickness of the supporting layer portion. By such a constitution, a print can also be provided by cutting off both outside portions of the image-receiving layer portion and the supporting layer portion from the easy-cut structures. A print to be stuck on an optional article can also be provided by cutting off only the center portion of the ink-receiving layer portion from the printing paper.

The easy-cut structure may be provided only in the vicinity of an edge of one side of the rectangle. However, when providing the structure in the vicinity of edges of both sides, the printing paper can be easier to be handled, in which it is necessary to consider the direction of the printing paper.

The form of the print obtained by cutting off the outside portions which lie outside the easy-cut structures by which the printing paper can be easily cut is preferably a rectangle with a ratio of a long side to a short side being about 855 to 540. In particular, when the length of the long side and the length of the short side are determined to be about 85.5 mm and about 54 mm, respectively, a print convenient for putting into a holder such as a purse or pocket notebook, which is so constructed that a telephone card and the like may be easy to be put into, can be provided, because it is equal in size to a telephone card or credit card.

The form of each edge of the four corners after cutting off the outside portions which lie outside the easy-cut structures, such as perforations, is preferably an arc form. When a curvature radius of the arc is determined to be 4 mm in particular, a print having the same form as a telephone card or credit card and convenient for holding can be provided.

The print forming process according to the present invention comprises the steps of:

providing such printing paper as described above, holding the outside portions of the printing paper to reciprocatorily convey the printing paper so as to pass through a printing position opposite to a printing head, and at the same time forming an image over substantially the whole surface of the center portion which lies nearer to the center of the printing paper than the easy-cut structure, and then cutting off the outside portions of the printing paper to provide a print, or separating the image-receiving layer portion of the center portion from the supporting layer portion to provide a print capable of being stuck on an article.

The printing system according to the present invention comprises such printing paper as described above, a printing head for conducting printing on the printing paper and a pair of conveyer rollers for holding the outside portions of the printing paper to convey the printing paper so as to cause substantially the whole surface of the center portion nearer to the center of the printing paper than the easy-cut structure of perforations to pass through a printing position opposite to the printing head.

In the printing system according to the present invention, particularly, a thermal transfer printing apparatus having a thermal head provided with a plurality of heating elements as the printing head, wherein an ink sheet coated with an ink is selectively heated by the thermal head to apply the ink to the printing paper, thereby conducting printing, may be suitably used.

In a thermal transfer printing apparatus, in which inks of plural colors are used to form images of plural colors by moving the printing paper in a reciprocating manner so as to overlap each other, thereby forming a color image, printing positions of the plural ink images must be exactly matched with each other. Therefore, the printing paper is required to be held without being released until formation of the ink images of the respective colors is completed. Accordingly, the printing system according to the present invention making use of the label printing paper having portions which lie nearer to an end than the easy-cut structure, and do not need to be printed and can be used as a support, can be suitably applied in particular to a printing system using such a printing apparatus.

DESCRIPTION OF THE PREFERRED EMBODIMENTS

The embodiments of the present invention will hereinafter be described by reference to the drawings.

Figure 1:
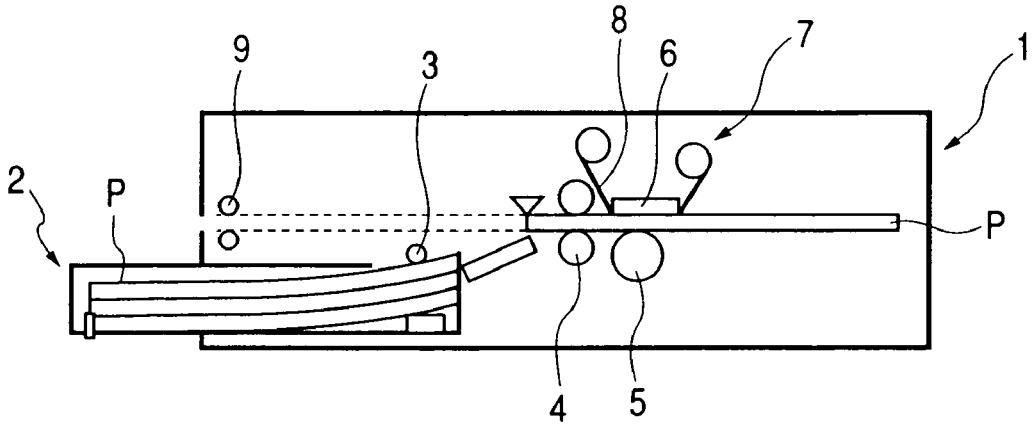
FIG. 1 is an illustrative side view of a thermal transfer printing apparatus used in the embodiments of the present invention.

As an example of a color image forming apparatus for forming a color image, an illustrative side view of a thermal transfer printing apparatus 1 is illustrated in FIG. 1. The thermal transfer printing apparatus 1 has a paper cassette 2 capable of stacking a plurality of printing paper sheets P. A paper feed roller 3 for separating one sheet from the printing paper sheets P stacked in the paper cassette 2 to feed it is provided above the paper cassette 2. A pair of conveyer rollers 4 for supporting and reciprocatorily moving the recording paper sheet P upon printing is provided at a position to which the printing paper sheet P is fed by the paper feed roller 3. A platen roller 5 for supporting the printing paper sheet P at an appropriate printing position and a thermal head 6 for pressing an ink sheet 8 against the printing paper sheet P and at the same time selectively heating the ink sheet 8 to conduct printing are provided in opposed relation to each other in a region where the reciprocating movement is conducted. A plurality of heating elements are provided in a row in the thermal head 6. The ink sheet 8 is contained in an ink cassette 7 and upon printing conveyed through the front of a surface of the thermal head 8, to which the printing paper sheet P is opposed. A pair of paper discharge rollers 9 for discharging the printing paper sheet P from the thermal transfer printing apparatus 1 are provided at a position to which the printing paper sheet P is discharged.

The ink sheet 8 has respective ink layers of yellow (Y), magenta (M) and cyan (C) colors and an overcoat layer provided with a protecting material overcoated on a printing surface of the printing paper sheet P for protecting the printing surface. The respective ink layers and the overcoat layer each have a width substantially equal to a width of a printing region of the printing paper sheet P and are provided in order in a conveying direction of the ink sheet 8.

The printing operation of an image by this thermal transfer printing apparatus 1 will now be described.

One of the printing paper sheets P stacked in the paper cassette 2 is separated by the paper feed roller 3 and fed to a nip portion between the pair of conveyer rollers 4. The ink cassette 7 is driven in such a manner that the ink layer of a first color is arranged in front of the surface of the thermal head 6, to which the recording surface is opposed. After the printing paper sheet P is supported and conveyed by the pair of conveyer rollers 4 to a starting position of printing, the driving of the thermal head 6 and conveyance of the printing paper sheet P by the pair of conveyer roller 4 are selectively conducted according to image data to form an image of the first color.

After the formation of the image of the first color is completed, the printing paper sheet P is returned to the starting position of the printing by driving the pair of conveyer rollers 4, and the ink cassette 7 is driven in such a manner that the ink layer of a second color is arranged in front of the surface of the thermal head 6, to which the recording surface is opposed. Thereafter, the driving of the thermal head 6 and conveyance of the printing paper sheet P by the pair of conveyer roller 4 are selectively conducted according to image data in the same manner as in the formation of the image of the first color, thereby forming an image of the second color so as to overlap the image of the first color.

In this manner, images of three colors are formed in order so as to overlap one another, and an overcoat layer is further formed thereon to form a color image. The printing paper sheet P on which the color image has been formed is discharged from the thermal transfer printing apparatus 1 by the pair of paper discharge rollers 9, thereby completing the printing operation.

As described above, the color image is formed by forming images of plural colors so as to overlap each other in the ordinary thermal transfer printing apparatus 1. Therefore, printing positions of the respective ink images must be exactly matched with each other. Thus, the printing paper sheet P is required to be held by the pair of conveyer rollers 4 without being released until formation of the ink images of the respective colors is completed.

Printing paper used in the thermal transfer printing apparatus 1 will now be described by reference to FIGS. 2 to 4A and 4B.

Figure 2:
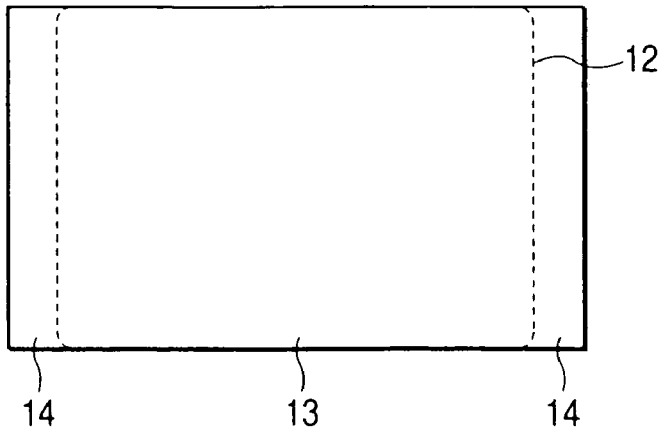
FIG. 2 illustrates printing paper according to an embodiment of the present invention.

As illustrated in FIG. 2, the printing paper has substantially a rectangular form and is provided with easy-cut structures 12, by which the printing paper can be easily cut, and which each extend over the entire width in the direction parallel to a short side of the printing paper, in the vicinity of both ends of a long side thereof. The easy-cut structure is preferably a perforation formed of, for example, intermittent cuts. Outside portions 14 which lie outside the perforation 12 can be cut off with ease by applying force to both outside portions with respect to the perforation 12. Each perforation 12 is formed of a straight line portion extending straight parallel to the short side of the printing paper at the center portion thereof, and curved portions smoothly curved in a direction toward the center of the long side of the printing paper and extending so as to be smoothly connected to both long sides of the printing paper at both ends of the straight line portion. More specifically, the perforations 12 are formed in such a manner that a center portion 13 of the printing paper becomes a form in which four corner edges thereof are rounded by cutting off the outside portions.

Figure 3A:
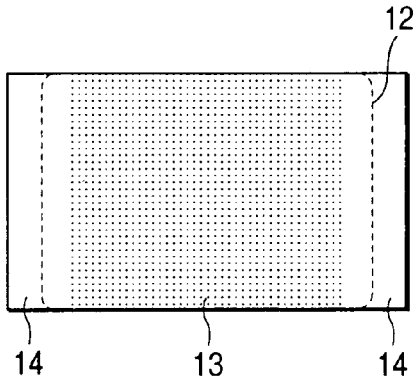
FIGS. 3A and 3B illustrate the printing paper shown in FIG. 2 after having conducted printing.
Figure 3B:
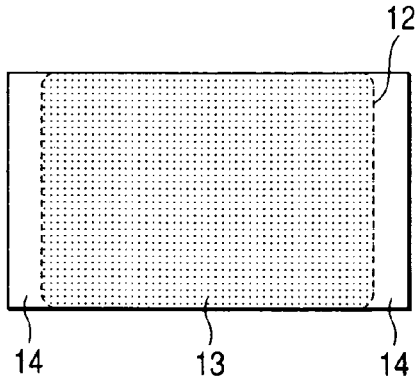

When printing is conducted on this printing paper, the outside portions 14 can be utilized as holding portions upon conducting reciprocating movement of the printing paper to form an image over substantially the whole surface of the center portion 13 which lies inside the perforations 12 of the printing paper as illustrated in FIG. 3B. More specifically, when the printing paper is conveyed in a right direction in FIG. 1 by the pair of conveyer rollers 4 in the thermal transfer printing apparatus 1, the outside portion 14 which lies outside the perforation 12 on a left side can be held by the pair of conveyer roller 4 to guide a left end of the center portion which lies inside the perforations 12 to a position opposite to the thermal head 6. Accordingly, an image can be formed over substantially the whole surface of the center portion 13 which lies inside the perforations 12 of the printing paper.

Figure 4A:
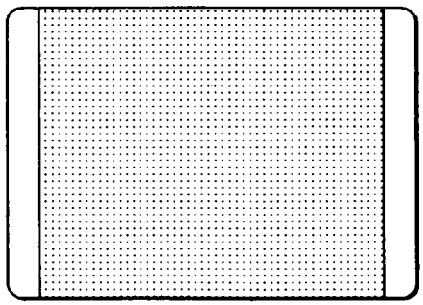
FIGS. 4A and 4B illustrate prints obtained by the embodiment of the present invention.
Figure 4B:
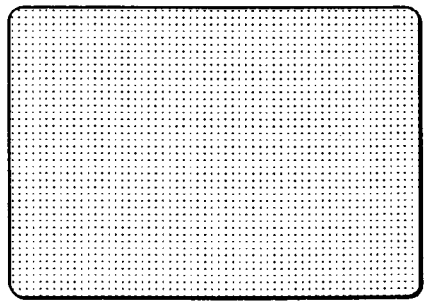

The outside portions 14 which lie outside the perforations 12 of the printing paper that has been printed in this manner and discharged from the printing apparatus are cut off, whereby the center portion 13 left after the cutting can be provided as a print in which an image has been formed over the whole surface thereof as illustrated in FIG. 4B. The resultant print has a form in which four corner edges thereof are rounded because the perforations 12 are formed in the above-described manner. Namely, a print easy to be held without striking on a holder or being caught thereby can be provided.

According to this printing paper, the size of the print after the outside portions 14 which lie outside the perforations 12 have been cut off is preferably 52.0 to 56.0 mm in short-side length and 83.5 to 87.5 mm in long-side length, particularly 54 mm in short-side length and 85.5 mm in long-side length. This size is equal to the size of a telephone card or credit card and is convenient for putting into a purse or pocket notebook to carry it. As described above, the perforations are desirably formed at positions with a ratio of the long side to the short side amounts to about 855 to 540 when the outside portions 14 have been cut off.

The form of each edge of the four corners after cutting off the outside portions which lie outside the perforations 12 is desirably an arc form. It is particularly desirable that the corner edge be formed so as to give an arc form having a curvature radius R of 4 mm like a telephone card or credit card.

Images illustrated in FIGS. 3A and 4A show examples in which printing has been conducted in such a manner that an image having an aspect ratio of 4:3, which is generally often used, is formed over the entire width parallel to the short side of the printing paper. At this time, the size of the image printed is 54 mm in short side and 72 mm in long side, and so a blank of 13.5 mm occurs in the direction parallel to the long side in the center portion 13 of the printing paper after the outside portions 12 have been cut off along the perforations 12. In the printing paper shown in FIG. 4A, this blank is divided into left and right portions to provide blank portions of 6.75 mm at the left and right end portions. As described above, prints in which an image has been formed over substantially the whole surface of the center portion 13 which lies inside the perforations 12 can be provided.

The printing paper may be provided as printing paper provided with a perforation 12 at only one side. However, when the printing paper provided with perforations 12 at both sides as illustrated in FIGS. 2 to 4A and 4B is used, the user can set the printing paper in a paper cassette with ease without considering the direction of the printing paper upon putting the printing paper into the cassette.

Figure 8:
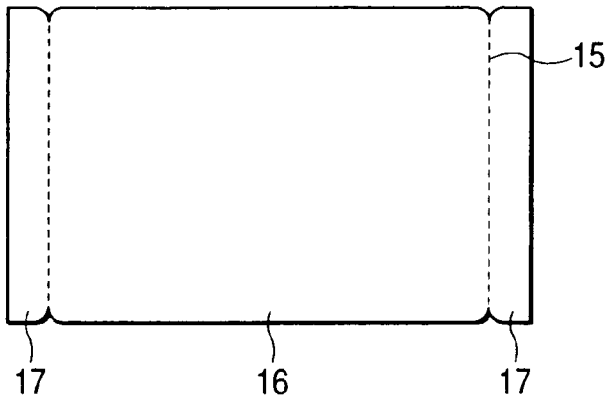
FIG. 8 illustrates printing paper according to another embodiment of the present invention.
Figure 9A:
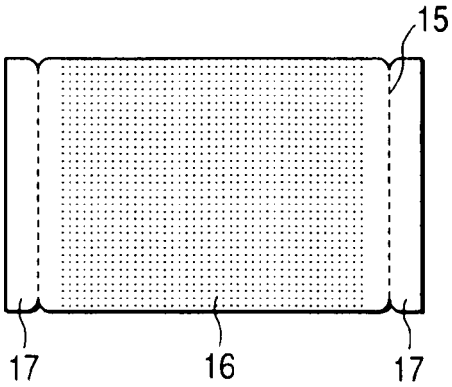
FIGS. 9A and 9B illustrate the printing paper shown in FIG. 8 after having conducted printing.
Figure 9B:
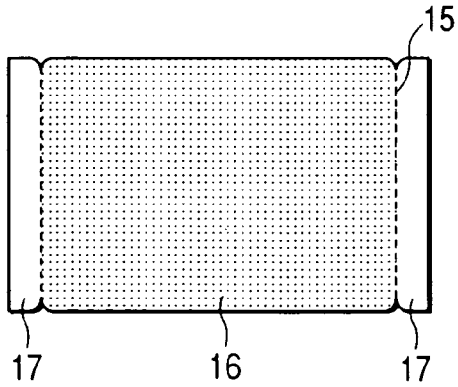

Printing paper according to another embodiment of the present invention is illustrated in FIGS. 8, 9A and 9B. This printing paper has substantially a rectangular form and is provided with easy-cut structures 15, extending straight parallel to the short side of the printing paper in the vicinity of both ends of the long side, by which the printing paper can be easily cut. It is preferred that the easy-cut structure is a perforation. In the upper and lower portions at which the perforation 15 intersects with the long side, notches having an edge that is smoothly connected to the perforation 15 and to the long side of the printing paper and smoothly curved in the form of a curve convex toward the outside of the printing paper are provided. Outside portions 17 which lie outside the perforation 12 are connected to a center portion 16 via a straight line portion located between the curved edges. The outside portions 17 can be easily cut off from the center portion 16. By cutting off the outside portions 17, the center portion 16 of the printing paper can be made in a form in which four corner edges thereof are rounded.

An image is printed on this printing paper in the same manner as in the printing paper illustrated in FIGS. 2 to 4A and 4B, whereby the image can be formed over substantially the whole surface of the center portion 16 which lies inside the perforations 15 of the printing paper. The outside portions 17 which lie outside the perforation 15 of the thus-printed printing paper are cut off, whereby the center portion 16 can be provided as a print in the form having the four corner edges rounded, in which the image has been formed over substantially the whole surface thereof as illustrated in FIG. 4B.

Incidentally, even in this embodiment, the size of the center portion after the outside portions 17 which lie outside the perforations 15 have been cut off is preferably 52.0 to 56.0 mm in short-side length and 83.5 to 87.5 mm in long-side length, particularly 54 mm in short-side length and 85.5 mm in long-side length. The image illustrated in FIG. 9A shows an example where printing has been conducted in such a manner that an image having an aspect ratio of 4:3 is formed over the entire width parallel to the short side of the printing paper. At this time, the size of the image printed is 54 mm in short side and 72 mm in long side, and so a blank of 13.5 mm, occurred in the direction parallel to the long side in the center portion 15 of the printing paper after the outside portions 17 have been cut off along the perforations 15, is divided into left and right portions to provide blank portions of 6.75 mm at the left and right end portions.

Figure 10:
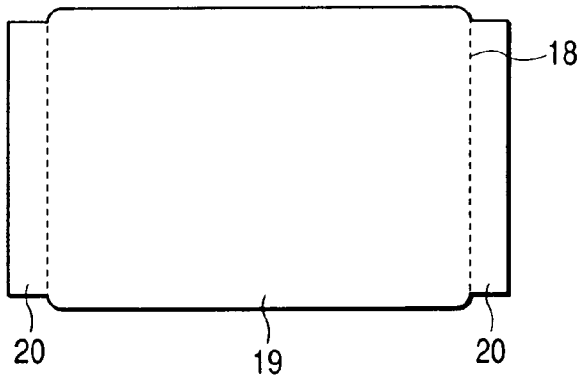
FIG. 10 illustrates printing paper according to a further embodiment of the present invention.
Figure 11A:
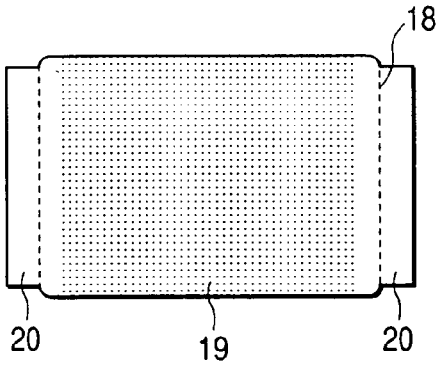
FIGS. 11A and 11B illustrate the printing paper shown in FIG. 10 after having conducted printing.
Figure 11B:
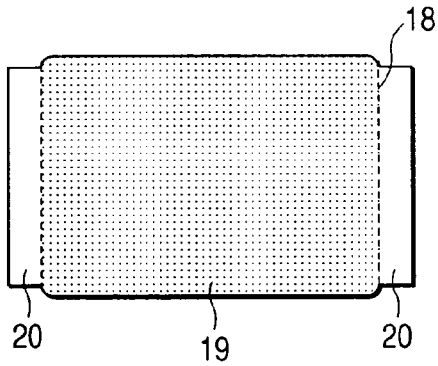
Figure 12:
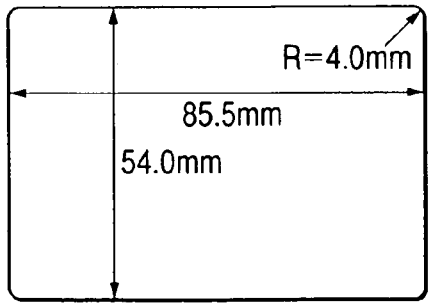
FIG. 12 illustrates the size and form of a telephone card or credit card.
Figure 13:
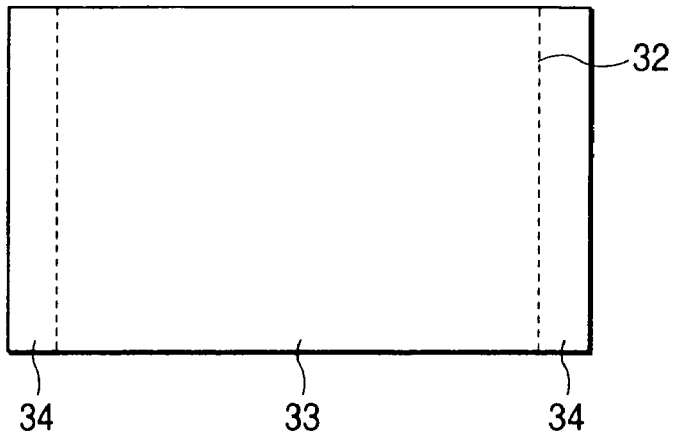
FIG. 13 PRIOR ART
FIG. 13 illustrates conventional printing paper.
Figure 14:
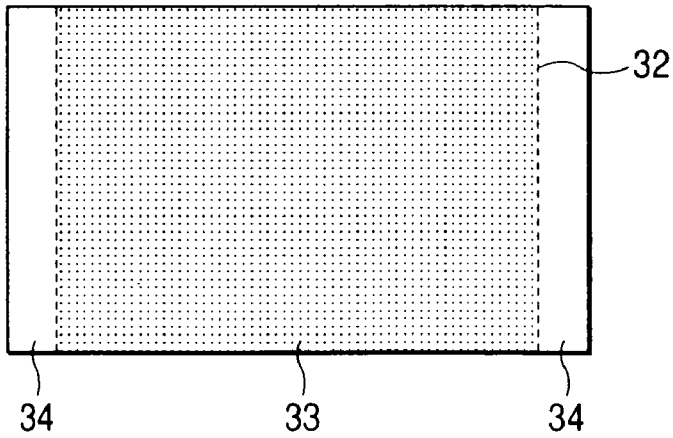
FIG. 14 PRIOR ART
FIG. 14 illustrates the printing paper shown in FIG. 13 after having conducted printing.
Figure 15:
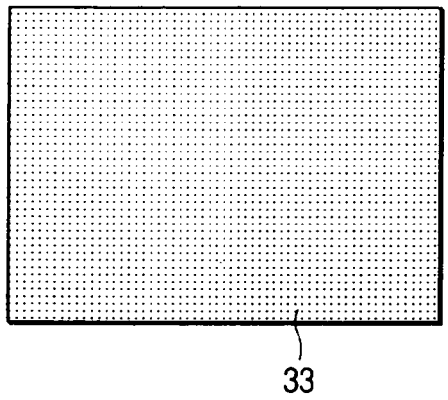
FIG. 15 PRIOR ART
FIG. 15 illustrates the printing paper shown in FIG. 13 after outside portions which lie outside a structure, by which the printing paper can be easily cut, have been cut off.
Figure 16:
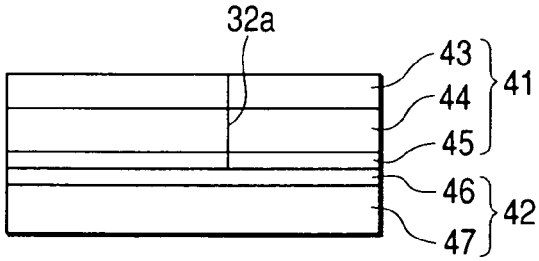
FIG. 16 PRIOR ART
FIG. 16 is an illustrative side view of label printing paper according to the prior art.
Figure 17:
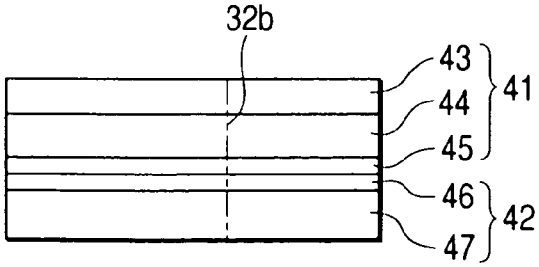
FIG. 17 PRIOR ART
FIG. 17 is an illustrative side view of another label printing paper according to the prior art.

Printing paper according to a further embodiment of the present invention is illustrated in FIGS. 10, 11A and 11B. This printing paper has substantially a rectangular form and comprises a center portion 19 having, at four corners thereof, an edge smoothly connected to short side and to long side thereof and smoothly curved in the form of a curve convex toward the outside of the printing paper, and outside portions 20 provided at both ends thereof. The outside portion 20 is in substantially a rectangular form having a side of a straight line portion connecting the curved portions of the center portion to each other in the direction parallel to the short side. At a joint between the center portion 19 and the outside portion 20, is provided each easy-cut structure 18 extending straight parallel to the short side of the printing paper, by which the printing paper can be easily cut. As the easy-cut structure 18 by which the printing paper can be easily cut, is preferred a perforation. The outside portions 20 can be easily cut off along the perforation 18. By cutting the outside portions 20 off, the printing paper can be made in a form in which four corner edges thereof are rounded.

An image is printed on this printing paper in the same manner as in the above-described embodiments, whereby the image can be formed over substantially the whole surface of the center portion 19 which lies inside the perforations 18 of the printing paper. The outside portions 20 of the thus-printed printing paper are cut off along the perforation 18, whereby the center portion 19 can be provided as a print in the form having the four corner edges rounded, in which the image has been formed over substantially the whole surface thereof as illustrated in FIG. 4B.

Incidentally, even in this embodiment, the size of the center portion after the outside portions 20 have been cut off along the perforation 18 is preferably 52.0 to 56.0 mm in short-side length and 83.5 to 87.5 mm in long-side length, particularly 54 mm in short-side length and 85.5 mm in long-side length. The image illustrated in FIG. 11A shows an example where printing has been conducted in such a manner that an image having an aspect ratio of 4:3 is formed over the entire width parallel to the short side of the printing paper. At this time, the size of the image printed is 54 mm in short side and 72 mm in long side, and so a blank of 13.5 mm, occurred in the direction parallel to the long side in the center portion 19 of the printing paper after the outside portions 20 have been cut off, is divided into left and right portions to provide blank portions of 6.75 mm at the left and right end portions.

When each printing paper described in FIGS. 2 to 4A and 4B and FIGS. 8 to 11A and 11B is label printing paper, the easy-cut structure 12, 15 or 18 by which the printing paper can be easily cut is as follows.

Figure 5:
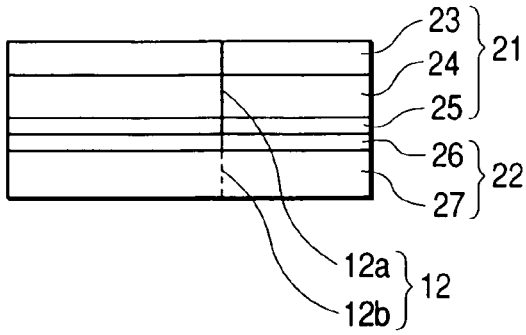
FIG. 5 is an illustrative side view of label printing paper according to the present invention.
Figure 6:
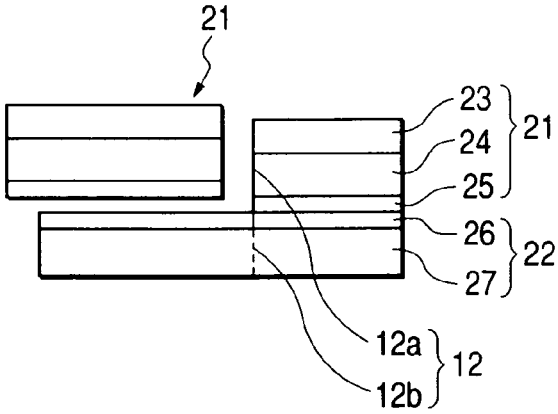
FIG. 6 is an illustrative side view illustrating a state that a center portion of an image-forming portion of the label printing paper shown in FIG. 5 has been separated.

As illustrated in FIG. 5, the label printing paper P is constructed by laminating an image-receiving layer portion 21 having a receiving layer 23, a sealing substrate 24 and an adhesive layer 25, and a supporting layer portion 22 having a releasing layer 26 and a supporting substrate 27 on each other. The image-receiving layer portion 21 can be separated from the supporting layer portion 22 to be stuck on an article. An easy-cut structure 12 of the label printing paper, by which the paper can be easily cut, is composed of a cutting line 12*a* formed of a cut continuously formed over the entire width over the entire thickness of the receiving layer portion 21 and a perforation 12*b* formed of cuts intermittently formed over the entire width over the entire thickness of the supporting layer portion 22. In this side view, the cutting line 12*a* formed of the cut continuously formed over the entire width and the perforation 12*b* formed of the cuts intermittently formed over the entire width are typically indicated by a solid line and a two-dot chain line, respectively.

As to the material of the receiving layer 23, any material may be used as long as it is a resin which easily receives a sublimate or melting coloring material (ink) transferred from an ink sheet by heating. For example, materials such as polyester resin, polybutyral resin, polyurethane resin, polyvinyl chloride resin, polyvinyl acetate resin or vinyl chloride-vinyl acetate copolymer resin may be used. Various kinds of plasticizers, antioxidants, ultraviolet absorbents, fluorescent brightening agents and the like may be mixed into the resin. As needed, a layer for preventing abnormal transfer may be provided on the receiving layer 23. As for the abnormal transfer-preventing layer, for example, an ultraviolet curable silicone resin, thermosetting silicone resin, fluorine-containing resin or the like may be used. Alternatively, various kinds of modified silicone oils, fluorine-containing oils, waxes and/or various kinds of surfactants may be mixed into the receiving layer 23. The thickness of the receiving layer is preferably 5 to 50 μm, more preferably 15 to 30 μm.

As for the sealing substrate 24 and supporting substrate 27, a film of a polymer such as polyester, polyethylene, polypropylene, polystyrene or polycarbonate, a film obtained by incorporating additives such as a filler and a softening agent into such a film, a laminate of these films, or a foam formed of such a material may be used. No particular limitation is imposed on the thickness of the substrate. However, it is preferably 10 to 50 μm.

As for the adhesive layer 25, an ordinary rubber adhesive or acrylic adhesive may be used. The thickness of the adhesive layer is about 5 to 30 μm. The releasing layer 26 can be formed by applying an ordinary ultraviolet curable silicone resin or thermosetting silicone resin to the supporting substrate 27, and the thickness thereof is preferably 0.05 to 0.5 μm.

An example of the preparation of the label printing paper according to the present invention will be now described.

A filler-contained, white polyethylene terephthalate film (PET film) having a thickness of 50 μm was used as a sealing substrate 24. Solution A having a composition shown in Table 1 was applied on this sealing substrate 24 so as to give a dry coating thickness of 10 μm to form an adhesive layer 25.

TABLE 1

| Component of Solution A | Content |
|---|---|
| Acrylic adhesive | 15 parts by weight |
| Trifunctional isocyanate | 0.5 parts by weight |
| Toluene | 85 parts by weight |

On the other hand, the same filler-contained, white PET film having a thickness of 100 μm as that used for the sealing substrate 24 was used as a supporting substrate 27. Solution B having a composition shown in Table 2 was applied on this supporting substrate 27 so as to give a dry coating thickness of about 0.1 μm to form a releasing layer 26.

TABLE 2

| Component of Solution B | Content |
|---|---|
| Silicone resin (X-62-7223A) | 0.5 parts by weight |
| Silicone resin (X-62-7223B) | 0.5 parts by weight |
| Hexane | 100 parts by weight |

The sealing substrate 24 on which the adhesive layer 25 had been formed and the supporting substrate 27 on which the releasing layer 26 had been formed were laminated on each other by pressing by a hand roller in such a manner that the adhesive layer 25 was brought into close contact with the releasing layer 26.

A sheet having a thickness of 15 μm produced by using Solution C having a composition shown in Table 3 was press-bonded under heating onto the sealing substrate 24 of the laminate thus obtained. Namely, a receiving layer 23 was formed by lamination.

TABLE 3

| Component of Solution C | Content |
|---|---|
| Polyester resin (Vylon 200; trade name, product of Toyobo Co., Ltd.) | 50 parts by weight |

TABLE 3-continued

| Component of Solution C | Content |
|---|---|
| Toluene | 120 parts by weight |
| Methyl ethyl ketone | 30 parts by weight |

The laminate thus obtained was then subjected to perforation treatment by which intermittent cuts were made over both image-receiving layer portion 21 and supporting layer portion 22, and then a continuous cut was made only in the image-receiving layer portion 21, i.e., subjected to half-cut treatment, thereby forming an easy-cut structure 12 composed of the cutting line 12*a* and the perforation 12*b*, by which the paper can be easily cut.

The label printing paper according to the present invention was obtained by the above-described process. Incidentally, the cutting line 12*a* may be formed not only in the image-receiving layer portion 21, but also to a part of the thickness of the supporting layer portion 22.

Figure 7:
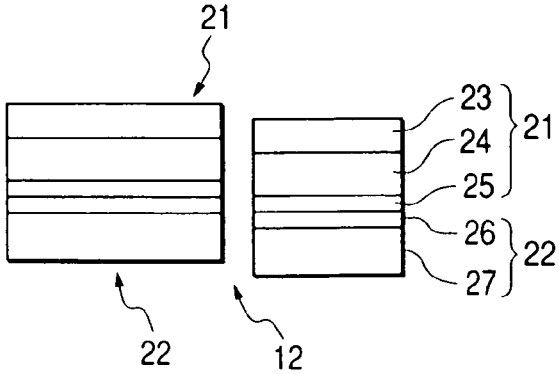
FIG. 7 is an illustrative side view illustrating a state that an outside portion of the label printing paper shown in FIG. 5 has been cut off.

Printing is conducted on the label printing paper described above in the same manner as in the printing paper illustrated in FIGS. 2 to 4A and 4B and FIGS. 8 to 11A and 11B. The outside portions 14, which lie outside the easy-cut structure 12 of the printing paper discharged from the printing apparatus, are cut off as illustrated in FIG. 7. The center portion 13 left after the cutting can be provided as a print in which an image has been formed over the whole surface thereof as illustrated in FIG. 4B. The resultant print has a form in which four corner edges thereof are rounded because the easy-cut structure 12, by which the paper can be easily cut, is formed in the above-described manner. Namely, the print has a form that is easy to be held and will not strike the holder or being caught by the holder when being put into a holder.

When the print is used for sticking on an article rather than being put into a purse, pocket notebook or the like, only the center portion 13 of the image-receiving layer portion 21 needs to be separated for use without cutting off the outside portion 14 of the supporting layer portion 22 along the perforation 12*b*. In this case, the outside portion 14 of the supporting layer portion 22 can be used as a supporting member upon the separation of the center portion 13 of the image-receiving layer portion 21, or used as a guide upon inserting a nail or the like between the image-receiving layer portion 21 and the supporting layer portion 22 at the portion of the cutting line 12*a*, thereby separating the image-receiving layer portion 21 from the supporting layer portion 22 with ease.

As described above, the present invention, provides prints capable of being stuck on optional articles, and having a form that can be easily put in a holder such as a purse, pocket notebook or card case without striking on the holder or being caught thereby. The present invention also provides a print forming process and a printing system which provide a print in which an image has been formed over substantially the whole surface thereof.

What is claimed is:

1. A printing process comprising the steps of:

providing a printing paper comprising a center portion having a rectangular form having two pairs of opposite sides connected by four corners, and a pair of outside portions connected to the center portion at one pair of the two pairs of opposite sides of the center portion, wherein the outside portions are edge portions of the printing paper and are removed from the center portion after an image is formed on the center portion, wherein the other pair of the two pairs of opposite sides of the center portion are not connected to any other printing paper, wherein the center portion has a curved edge smoothly connecting adjacent sides of the center portion at four corners, and the outside portions are connected to the center portion solely via a straight line portion located between the curved edges and are removed from the center portion at the straight line portion, and wherein the outside portions are connected to only one center portion;

conveying the printing paper by nipping one of the outside portions of the printing paper with a pair of conveyor rollers;

conducting printing on the center portion of the printing paper; and cutting off the outside portions of the printing paper from the center portion, wherein the outside portions are provided so that the pair of conveyer rollers hold the printing paper without releasing the printing paper until the printing is completed, and wherein the printing can be conducted over the whole surface of the center portion even if the printing paper is conveyed to a print head with either one of the pair of outside portions as a leading edge.

2. The printing process according to claim 1, wherein the printing paper has perforations between the center portion and the outside portions.

3. A printing process comprising the steps of:

providing a label printing paper comprising an image receiving layer releasably laminated on a supporting layer, the label printing paper having a center portion having a rectangular form having two pairs of opposite sides connected by four corners and a pair of outside portions connected to the center portion at one pair of the two pairs of opposite sides of the center portion, wherein the outside portions are edge portions of the printing paper and are removed from the center portion after an image is formed on the center portion, wherein the other pair of the two pairs of opposite sides of the center portion are not connected to any other label printing paper, wherein the center portion has a curved edge smoothly connecting adjacent sides of the center portion at four corners, and the outside portions solely are connected to the center portion via a straight line portion located between the curved edges and are removed from the center portion at the straight line portion, and wherein the outside portions are connected to only one center portion;

conveying the label printing paper while by nipping holding one of the outside portions of the label printing paper with a pair of conveyor rollers;

conducting printing on the center portion of the label printing paper; and separating the image-receiving layer at the center portion from the supporting layer, wherein the outside portions are provided so that the pair of conveyer rollers hold the label printing paper without releasing the label printing paper until the printing is completed, and wherein the printing can be conducted over the whole surface of the center portion even if the label printing paper is conveyed to a print head with either one of the pair of outside portions as a leading edge.

4. The printing process according to claim 3, wherein the printing paper has perforations between the center portion and the outer portions.

5. A printing system comprising:

a printing paper comprising a center portion having a rectangular form having two pairs of opposite sides connected by four corners, and a pair of outside portions connected to the center portion at one pair of the two pairs of opposite sides of the center portion, wherein the outside portions are edge portions of the printing paper and are removed from the center portion after an image is formed on the center portion, wherein the other pair of the two pairs of opposite sides of the center portion are not connected to any other printing paper, wherein the center portion has a curved edge smoothly connecting adjacent sides of the center portion at four corners, and the outside portions are connected to the center portion solely via a straight line portion located between the curved edges and are removed from the center portion at the straight line portion, and wherein the outside portions are connected to only one center portion;

a print head for conducting printing on the center portion of the printing paper; and a pair of conveyer rollers for nipping the outside portions of the printing paper to convey the printing paper, wherein the outside portions are provided so that the pair of conveyer rollers hold the printing paper without releasing the printing paper until the printing is completed, and wherein the printing can be conducted over the whole surface of the center portion even if the printing paper is conveyed to the print head with either one of the pair of outside portions as a leading edge.

6. The printing system according to claim 5, wherein each curved edge of the printing paper is an arc form.

7. A printing system comprising:

a label printing paper comprising an image receiving layer releasably laminated on a supporting layer, the label printing paper having a center portion having a rectangular form having two pairs of opposite sides connected by four corners and a pair of outside portions connected to the center portion at one pair of the two pairs of opposite sides of the center portion, wherein the outside portions are edge portions of the printing paper and are removed from the center portion after an image is formed on the center portion, wherein the other pair of the two pairs of opposite sides of the center portion are not connected to any other label printing paper, wherein the center portion has a curved edge smoothly connecting adjacent sides of the center portion at four corners, and the outside portions are connected to the center portion solely via a straight line portion located between the curved edges and are removed from the center portion at the straight line portion, and wherein the outside portions are connected to only one center portion;

a print head for conducting printing on the center portion of the label printing paper; and a pair of conveyer rollers for nipping the outside portions of the label printing paper to convey the label printing paper, wherein the outside portions are provided so that the pair of conveyer rollers hold the label printing paper without releasing the label printing paper until the printing is completed, and wherein the printing can be conducted over the whole surface of the center portion even if the label printing paper is conveyed to the print head with either one of the pair of outside portions as a leading edge.

8. The printing system according to claim 7, wherein each curved edge of the label printing paper is an arc form.

* * * * *

UNITED STATES PATENT AND TRADEMARK OFFICE

CERTIFICATE OF CORRECTION

PATENT NO. : 7,033,095 B2
APPLICATION NO. : 09/835443
DATED : April 25, 2006
INVENTOR(S) : Yoshinobu Shiraiwa It is certified that error appears in the above-identified patent and that said Letters Patent is hereby corrected as shown below:

COVER PAGE AT ITEM [56] RC:
Foreign Patent Documents, "09263075" should read --9-263075--; "07061170" should read --7-61170--; and "10006594" should read --10-6594--.

COLUMN 2:
Line 4, "image" should read --an image--.

COLUMN 3:
Line 38, "receiprocatorily moves printing paper" should read --moves printing paper in a reciprocating manner--; and "formal" should read --form--.

COLUMN 5:
Line 17, "reciprocatorily" should read --in a reciprocating manner--.

COLUMN 6:
Line 44, "reciprocatorily" should read --in a reciprocating manner--.

COLUMN 7:
Line 15, "roller" should read --rollers--.
Line 26, "roller" should read --rollers--.

COLUMN 8:
Line 13, "roller" should read --rollers--.

COLUMN 9:
Line 54, "short" should read --the short--.
Line 55, "long" should read --the long--.

COLUMN 12:
Line 33, "or being" should read --or be--.

UNITED STATES PATENT AND TRADEMARK OFFICE

CERTIFICATE OF CORRECTION

PATENT NO. : 7,033,095 B2
APPLICATION NO. : 09/835443
DATED : April 25, 2006
INVENTOR(S) : Yoshinobu Shiraiwa It is certified that error appears in the above-identified patent and that said Letters Patent is hereby corrected as shown below:

COLUMN 13:
Line 42, "portions solely" should read --portions--.
Line 43, "portion" should read --portion solely--.
Line 48, "while" should be deleted.
Line 49, "holding" should be deleted.

Signed and Sealed this

Sixth Day of February, 2007

JON W. DUDAS
*Director of the United States Patent and Trademark Office*